US005755615A

United States Patent [19]

Kiriyama

[11] Patent Number: 5,755,615

[45] Date of Patent: May 26, 1998

[54] LAPPING APPARATUS

[75] Inventor: Kazuo Kiriyama, Aichi-ken, Japan

[73] Assignee: Toyota Jidosha Kabushiki Kaisha, Toyota, Japan

[21] Appl. No.: 743,340

[22] Filed: Nov. 4, 1996

[30] Foreign Application Priority Data

Nov. 13, 1995 [JP] Japan ..... 7-318566

[51] Int. Cl.[6] ..... B24B 7/00

[52] U.S. Cl. ..... 451/190; 451/49; 451/302; 451/306

[58] Field of Search ..... 451/108, 302, 451/306, 305, 309, 310, 49, 303, 311, 173

[56] References Cited

U.S. PATENT DOCUMENTS

| | | | |
|---|---|---|---|
| 4,993,191 | 2/1991 | Judge et al. | 451/168 |
| 4,999,953 | 3/1991 | Kinugawa | 451/303 |
| 5,065,548 | 11/1991 | Shimizu et al. . | |
| 5,088,240 | 2/1992 | Ruble et al. . | |
| 5,437,125 | 8/1995 | Barton, II . | |
| 5,536,201 | 7/1996 | Winkelmann | 451/168 |
| 5,651,719 | 7/1997 | Pineau | 451/303 |

FOREIGN PATENT DOCUMENTS

| | | |
|---|---|---|
| 0 349 653 | 1/1990 | European Pat. Off. . |
| 9 366 506 | 5/1990 | European Pat. Off. . |
| 0 434 533 | 6/1991 | European Pat. Off. . |
| 60-7952 | 1/1985 | Japan . |
| 3-88657 | 9/1991 | Japan . |
| 5-169361 | 7/1993 | Japan . |
| 6-55430 | 3/1994 | Japan . |
| 7-75953 | 3/1995 | Japan . |

*Primary Examiner*—Robert A. Rose
*Assistant Examiner*—George Nguyen
*Attorney, Agent, or Firm*—Oliff & Berridge, PLC

[57] ABSTRACT

A lapping apparatus for improving the durability of a lap film and the reliability of a lapping apparatus. A shoe having a recessed workpiece retaining section is installed on each of the opposed faces of a pair of clamp arms. A deep groove is formed in the center of the workpiece retaining section. Guide plates are fixed to the shoe so as to block both sides of the deep groove. A drawing roller is disposed in the deep groove and the rotation shaft of the drawing roller is supported by the guide plates. A lap film is introduced to the workpiece retaining sections of the shoes, drawn into the deep grooves in the center of the workpiece retaining sections, and hung around the drawing rollers. Even when the lap film is being fed, the lap film feeding path remains unchanged. Thus, there is no need to clamp the workpiece with a high pressure to bring the lap film into close contact with the face of the workpiece to be processed.

2 Claims, 10 Drawing Sheets

LAPPING APPARATUS

BACKGROUND OF THE INVENTION

1. Field of the Invention

The present invention relates to a lapping apparatus for grinding an external surface of an axial work.

2. Description of the Related Art

The lapping apparatus is used for grinding process to provide the surface of a pin portion, a journal portion or the like of a crankshaft with an excellent property. Such lapping apparatus is schematically shown in FIG. 10. A lapping apparatus 1 has a feeding mechanism for introducing a belt-shaped lap film 2 containing abrasive grain for abrasion gradually to opposed surfaces of a clamp arm 8. Then, by clamping a workpiece with the clamp arms 8, the lap film is brought into close contact with the workpiece and then the workpiece is rotated so that the surface thereof can be ground.

Meanwhile, the feeding mechanism for the lap film is shown in FIG. 11. A predetermined amount of the lap film is wound on a roll 5 and the roll 5 is loaded on a supply section 6. The lap film 2, unwound from the supply section 6, passes through a plurality of guide rollers 7*a* to 7*f* and then is introduced to the vicinity of a front end of a clamp arm 8*a*, which is one of the clamp arms 8 acting cooperatively. The clamp arms 8*a*, 8*b* are opened and closed by a drive means such as a cylinder. Shoes 4, which have recessed workpiece retaining sections 9 thereon, are provided on the opposed faces of the clamp arms 8*a*, 8*b* respectively. The guide roller 7*c* is provided with a torque limiter to selectively stop feeding of the lap film 2.

Next, the lap film 2 passes around the guide roller 7*f* which is located near the front end of the clamp arm 8*a* and moves upward to pass over a front face of one of the shoes 4*a*. Then, the lap film 2 is hung around the guide roller 7*g* which is located further upward and moves downward to pass over a front face of the other shoe 4*b* mounted on the clamp arm 8*b*. Further, the lap film is guided by the guide rollers 7*h*, 7*i* which are located near the front end of the clamp arm 8*b* and then held by a catching preventive roller 10. The catching preventive roller 10 basically prevents the lap film 2 from proceeding in the opposite direction. However, it allows the film to proceed in the opposite direction if a force greater than a predetermined value is applied to the lap film 2. After passing the catching preventive roller 10, the lap film 2 is further hung around the guide rollers 7*j*, 7*k* and rewound by rewinding rollers 12 of a rewinding section 11. Then, it is collected by a used film collection box 13. According to this type of lapping apparatus, the rewinding rollers 12 are the only drive source for rewinding the lap film 2. The catching preventive roller 10 and the torque limiter provided on the guide roller 7*c* give an appropriate tension to the lap film 2, allowing it to be fed through the aforementioned mechanism smoothly.

In grinding a workpiece 3 with the above lapping apparatus, the workpiece retaining sections 9 of the shoes 4 retain the workpiece 3 therebetween. At this time, one of the workpiece retaining sections 9 and the workpiece 3 clamp the lap film 2 to bring it into close contact with the face of the workpiece 3 to be processed. While the face of the workpiece 3 to be processed is kept in close contact with the lap film, the workpiece 3 is rotated. In this way, the grinding operation is performed. The catching preventive roller 10 prevents the lap film 2 from proceeding in the opposite direction and at the same time, the torque limiter provided on the guide roller 7*c* prevents the lap film 2 from being drawn out excessively. Thus, it is possible to prevent a friction force generated by rotating the workpiece 3 from resulting in unnecessary drawing of the lap film 2, which is likely to deprive the lap film 2 of an appropriate tension, allow it to be stuck in the way, and eventually cause a significant damage thereto.

After the grinding operation is terminated, the clamp arm 8 is opened and the apparatus is shifted upwardly of the workpiece 3. Then, the rewinding rollers 12 are rotated by a predetermined angle to draw out the lap film 2 such that the used film portion is taken from the front face of the shoe 4 and an unused film portion is fed thereto. At this time, the lap film 2 is further drawn out from the feeding section 4. Such feeding operation of the lap film is carried out every time a single grinding operation is terminated, thereby to prepare for the subsequent operation. In performing another grinding operation subsequently, the apparatus is shifted downward and then the clamp arm 8 is closed such that the workpiece 3 is retained by the shoes 4*a*, 4*b*. Thus, lapping operation of the workpiece 3 may be automatically performed. An example of a conventional lapping apparatus using lap film is disclosed in Japanese Patent Laid-open No. Hei 5-169361.

However, the lapping apparatus having the above-described construction has the following problems. As shown in FIG. 12, every time the operation is performed, the lap film must be brought into close contact with the face of the workpiece 3 to be processed. In this state, the path taken by the lap film 2 substantially fits the face of the workpiece 3 to be processed and the recessed wall surfaces of the workpiece retaining sections 9. However, when the feeding operation is performed, the lap film 2 is wound only in one direction by the roller 12 (see FIG. 11). Consequently, as shown in FIG. 13, the lap film 2 is removed from the recessed wall surfaces of the workpiece retaining sections 9 and stretched to form a straight line between the guide rollers 7*f*, 7*h* and the guide roller 7*g*. Namely, in comparison with the state during the grinding operation as shown in FIG. 12, the running distance of the lap film 2 becomes shorter.

Then, when the clamp arms 8*a*, 8*b* are closed to retain the workpiece 3 by means of the shoes 4 as shown in FIG. 14, thereby to bring the lap film 2 into close contact with the face of the workpiece 3 to be processed, it is necessary to implement a high pressure clamping operation to draw out the lamp film 2. Such clamping operation must be continued until the path of the lap film 2 returns to the state during the grinding operation and the lap film 2 fits the recessed wall surfaces of the workpiece retaining sections 9. In implementing the high pressure clamping operation, because the lap film 2 is kept from proceeding in the opposite direction by the catching preventive roller 10, it is ensured that the lap film 2 is drawn out only from the supply section 6 (see FIG. 11). Furthermore, because a substantial drawing force (indicated by arrow C) is applied to the catching preventive roller 10 in the opposite direction of the lap film 2, there arises a considerable stress on a mounting bracket 36 of the catching preventive roller 10. Thus, if the high pressure clamping operation is repeated many times, the mounting bracket tends to be exhausted and damaged. Furthermore, the shoe 4 which is subject to high pressure also tends to be damaged. Still further, because the aforementioned high pressure clamping operation necessitates a pressure too high to perform the grinding operation. As a result, operation accuracy is deteriorated. Therefore, it is necessary to perform an excessive operation, for example, to reduce the pressure before starting the grinding operation. Thus, a more efficient lapping apparatus has been demanded in the market.

SUMMARY OF THE INVENTION

Accordingly, it is an object of the present invention to provide a lapping apparatus using a novel feeding mechanism for guiding a lap film which prevents any excessive tension from being applied to the lap film and enhances the durability of the lap film and the reliability of the lapping apparatus.

To this end, there is provided a lapping apparatus wherein a feeding mechanism for guiding a lap film successively is provided on shoes having recessed workpiece retaining sections disposed on the opposed faces of a pair of clamp arms respectively, a workpiece is clamped together with the lap film by the workpiece retaining sections, and the lapping operation is performed by rotating the workpiece relative to the lap film, the lapping apparatus comprising a guiding means for constantly fitting the lap film to the recessed wall surfaces of the workpiece retaining sections.

According to another aspect of the present invention, there is provided a lapping apparatus wherein a feeding mechanism for guiding a lap film successively is provided on shoes having recessed workpiece retaining sections disposed on the opposed faces of a pair of clamp arms respectively, a workpiece is clamped together with the lap film by the workpiece retaining sections, and the lapping operation is performed by rotating the workpiece relative to the lap film, the feeding mechanism for the lap film comprising a winding section and a supply section for the lap film, the winding section and the supply section being provided with drive means respectively.

According to the present invention, the guiding means for constantly fitting the lap film to the recessed wall surfaces of the workpiece retaining sections formed on the shoes ensures that there is no change in running distance of the lap film to be guided.

Furthermore, according to the present invention, because the feeding mechanism for the lap film comprises a winding section and a supply section for the lap film and the winding section and the supply section are provided with drive means respectively, the lap film is wound by the drive means of the winding section and the tension applied to the lap film is adjusted by the drive means of the supply section.

DESCRIPTION OF THE PREFERRED EMBODIMENTS

Figure 1:
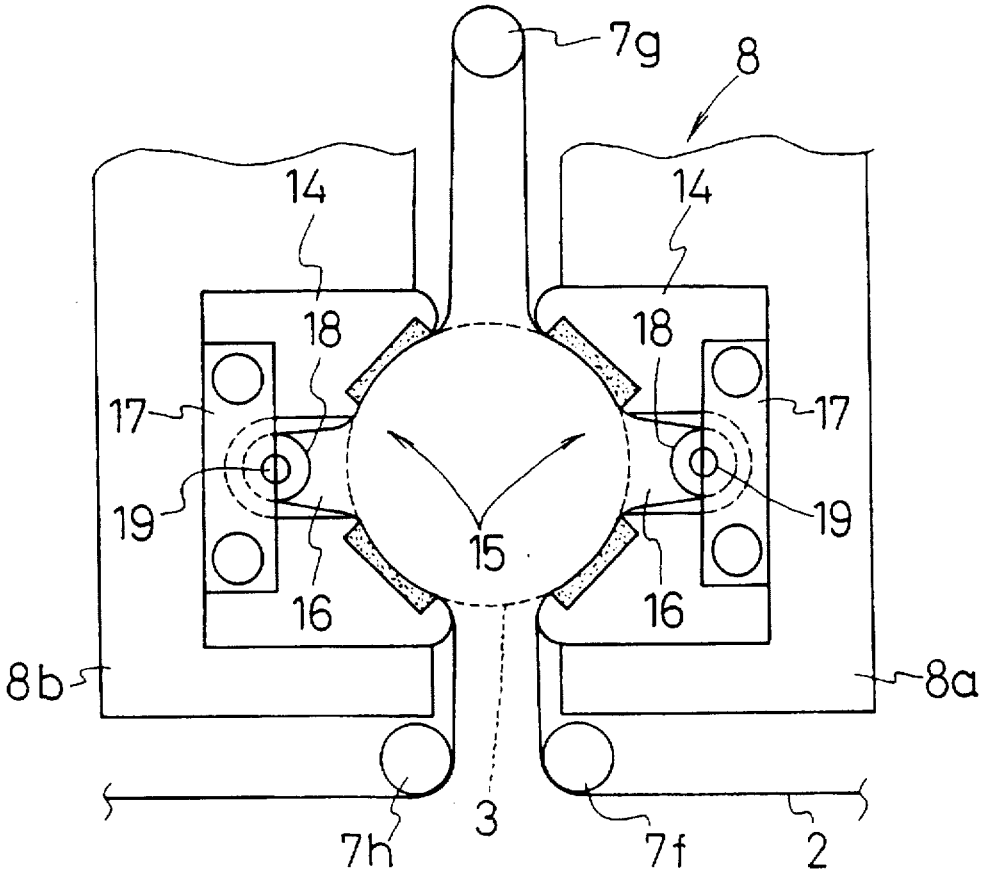
FIG. 1 is a schematic diagram showing a front end portion of a clamp arm of a lapping apparatus according to a first embodiment of the present invention.

A first embodiment of the present invention will be described below with reference to FIGS. 1 and 2. It is to be noted that the same reference numerals are allocated to the components similar to or corresponding to those in the related art, and that the explanation thereof will be omitted.

Figure 2:
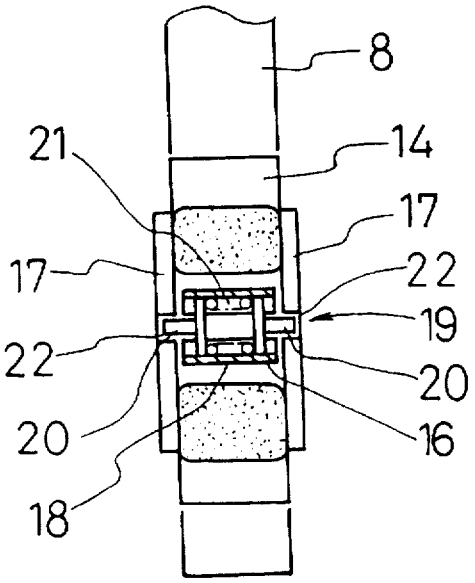
FIG. 2 is a side view showing the front end portion of the clamp arm as shown in FIG. 1.

FIG. 1 shows a front end portion of a clamp arm 8 of a lapping apparatus. As shown in the figure, shoes 14 are mounted on opposed faces of clamp arms 8*a*, 8*b* respectively. A recessed workpiece retaining section 15 is formed on each of the shoes 14. Furthermore, in this embodiment, a guiding means for constantly fitting a lap film 2 to recessed wall surfaces of the workpiece retaining sections 15. The construction of this guiding means will be described later.

A deep groove 16 is formed in the center of the workpiece retaining section 15 formed in the shoe 14. A pair of guide plates 17 are fixed on each of the shoes 14 so as to block both sides of the deep groove 16. A drawing roller 18 is disposed in the deep grooves 16 and a shaft 19 about which the drawing roller 18 is rotated is supported by the pair of guide plates 17. As shown in FIG. 2, the shaft 19 comprises a pair of set pins 20 and a spring 21 disposed therebetween. Then, the set pins 20 are urged to the outside by the spring 21 such that they are fitted into shaft holes 22 formed through the guide plates 17. Therefore, by pressing the set pins 20, they are disengaged from the shaft holes 22 formed through the guide plates 17, so that the drawing roller 18 can be removed easily from the shoe 14. The drawing roller 18 can be mounted to the shoe 14 by fitting the set pins 20 into the shaft holes 22 of the guide plates 17.

According to this embodiment, the lap film 2 is introduced to the workpiece retaining sections 15 of the shoe 14, drawn into the deep grooves 16 in the center of the workpiece retaining section 15, and hung around the drawing roller 18. At this time, the drawing roller 18 is removed from the shoe 14 and then the lap film 2 is introduced in front of the workpiece retaining section 15. After that, the lap film 2 is pushed into the deep groove 16 by the drawing roller 18 and the set pins 20 are fitted into the shaft holes 22 to mount the drawing roller 18 on the shoe 14. Consequently, the drawing rollers 18 provide between the guide rollers 7*f* and 7*g* and between the guide rollers 7*g* and 7*h* a guiding path along which the lap film 2 is inevitably introduced to the deep grooves 16. Thus, the lap film 2 is guided along the recessed wall surfaces of the workpiece retaining sections 15. Although the construction of the front end portion of the clamp arm 8 according to this embodiment has been described in detail, the explanation of the other components, which have constructions similar to those in the prior art, is omitted here.

Figure 14:
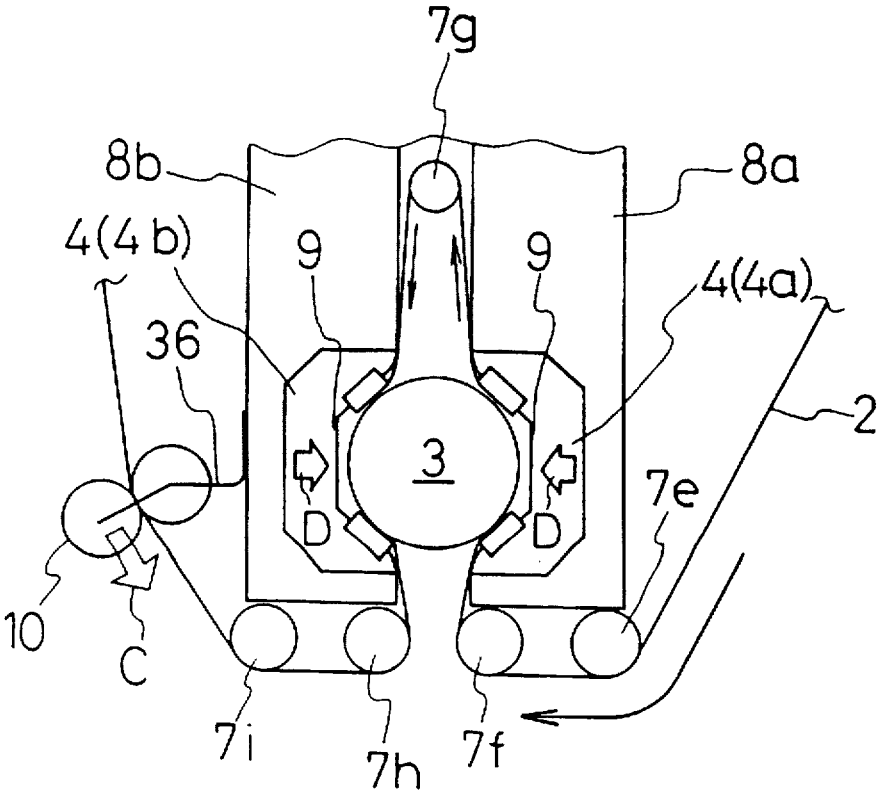
F I G .14 PRIOR ART
FIG. 14 is a schematic diagram showing a second step of the lap film feeding operation by means of the lapping apparatus as shown in FIG. 10.

Operation and effect of the first embodiment of the present invention will be described below. Since the above-described guiding path formed in the shoes 14 does not change regardless of whether the lap film 2 is being fed or a workpiece is about to be clamped again, the lap does not leave the recessed wall surfaces of the workpiece retaining sections even when the workpiece 3 is about to be clamped, as in the prior art. Therefore, the guiding path of the lap film 2 is not reduced. Accordingly, the high pressure clamping operation for drawing out the lap film 2 to prepare for the subsequent grinding operation becomes unnecessary. Since such wasteful high pressure clamping operation can be eliminated, there is no more significant stress applied to the mounting bracket 36 of the catching preventive roller 10 as indicated by arrow C in FIG. 14, which improves the durability of the lapping apparatus. Additionally, the possibility of the lap film being cut by the aforementioned stress may be reduced.

Furthermore, when the lap film 2 is introduced to one of the deep grooves 16, both sides of the deep groove 16 are blocked by the guide plates 17. Accordingly, any deviation in width of the lap film 2 is corrected and the lap film 2 is prevented from falling off the shoe 14.

Next, a second embodiment of the present invention will be described with reference to FIGS. 3 and 4. In the second embodiment, detailed description of the part similar or equivalent to the first embodiment is omitted. According to this embodiment, the guiding means for the lap film as described in the first embodiment is applied to a lapping apparatus which uses a lap film 20 stored in a cassette type casing.

Here, the lap film 20 stored in a cassette type casing will be explained briefly with reference to FIG. 4. The film 20 stored in the cassette type casing is much easier to handle. A casing 21 contains a winding reel 23 serving as a winding portion for winding the lap film 2 and a supply reel 24 serving as a supply portion for supplying the lap film 2 therein. The lap film 2 is supplied and received between both the reels The casing 21 supports the shoe 22 and plays a role of the front end portion of the clamp arm. The shoe 22 used here has the same guiding means as the shoe 14 already explained in the first embodiment, thus a description thereof is omitted.

The casing 21 has an opening on one side thereof, which enables the winding reel 23 and the supply reel 24 to be loaded easily. Then, when loading the lap film, the supply reel 24 on which an unused lap film 2 is wound and an unloaded winding reel 23 are mounted on predetermined positions within the casing, and the lap film 2 is drawn out from the supply reel 24, hung around the guiding means of the shoe 22, and finally wound on the winding reel 23.

In the meantime, the casing 21 is provided with a stopper 25 for restricting the rotation of the winding reel 23 and the supply reel 24. The stopper 25 has two-branched arms 251, 252 and a rotation shaft 253 extending in a direction perpendicular to the arms is disposed at the root of the arm. The stopper 25 is supported by the rotation shaft 253 such that the stopper 25 is allowed to leave or approach the casing 21. Then, the stopper 25 is fitted to the side faces of the winding reel 23 and the supply reel 24 by an urging means (not shown). In addition, click faces 231, 241 in each of which a plurality of threads and roots are alternately arranged to form a circle as a whole, are formed on the side faces of the winding reel 23 and the supply reel 24 respectively. The arms 251,252 of the stopper 25 are provided with protrusions which engage the click faces 231, 241. Consequently, when the stopper 25 is fitted to the side faces of the winding reel 23 and the supply reel 24, the rotating movement of the winding reel 23 and the supply reel 24 is restricted. This prevents the lap film 2 from proceeding in the opposite direction or being drawn out excessively. Thus, when grinding the work, it is possible to prevent the lap film 2 from being stuck in the way and being damaged.

Figure 4:
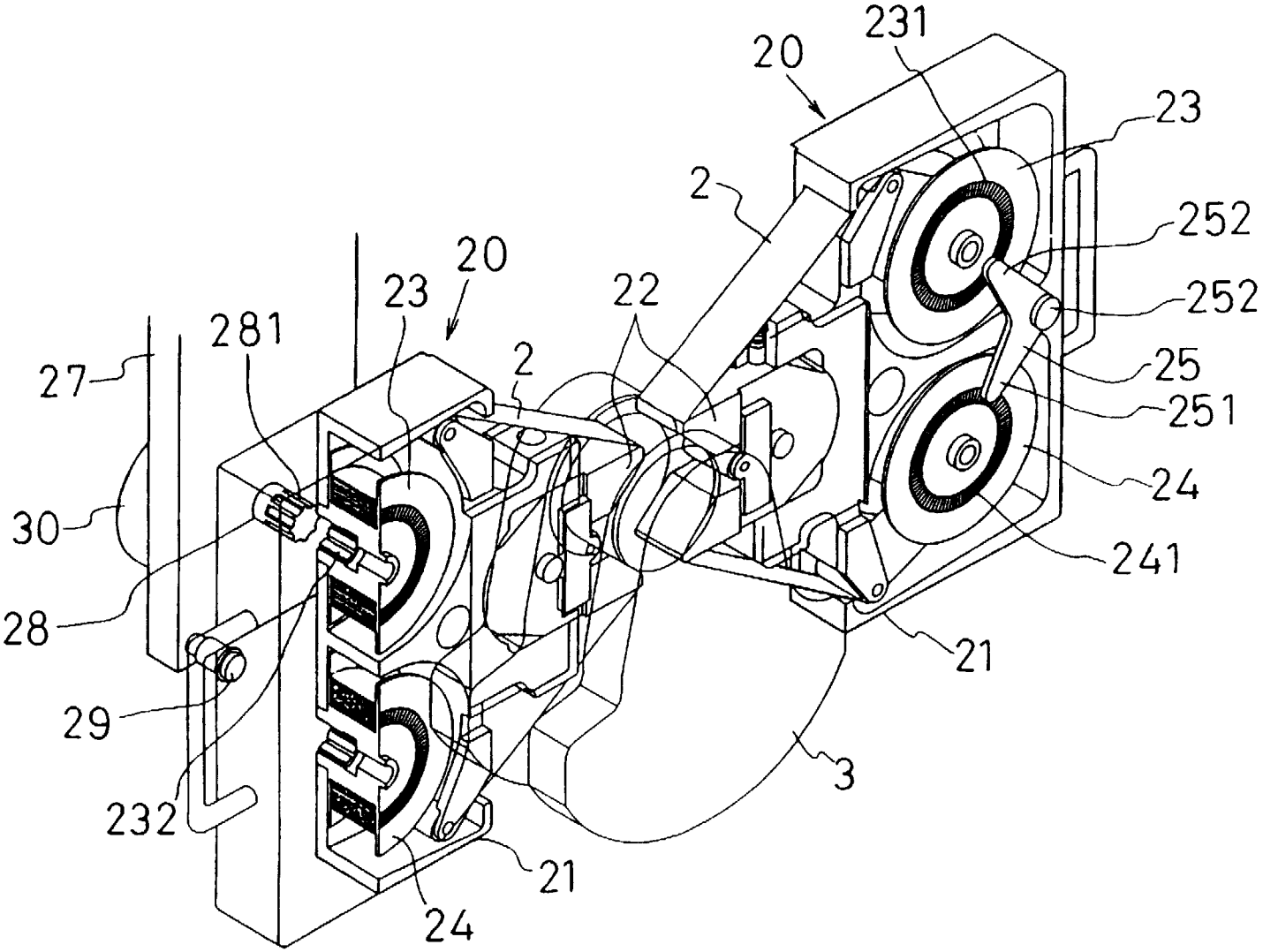
FIG. 4 is a perspective view showing the internal construction of the lapping apparatus as shown in FIG. 3.

In replacing the winding reel 23 and the supply reel 24, the stopper 25 is removed from the side faces of the winding reel 23 and the supply reel 24, and then rotated by 180° about the rotation shaft 253 from a position as shown in FIG. 4. In this state, the stopper is no more an obstacle in removing or installing the winding reel 23 and the supply reel 24.

Figure 3:
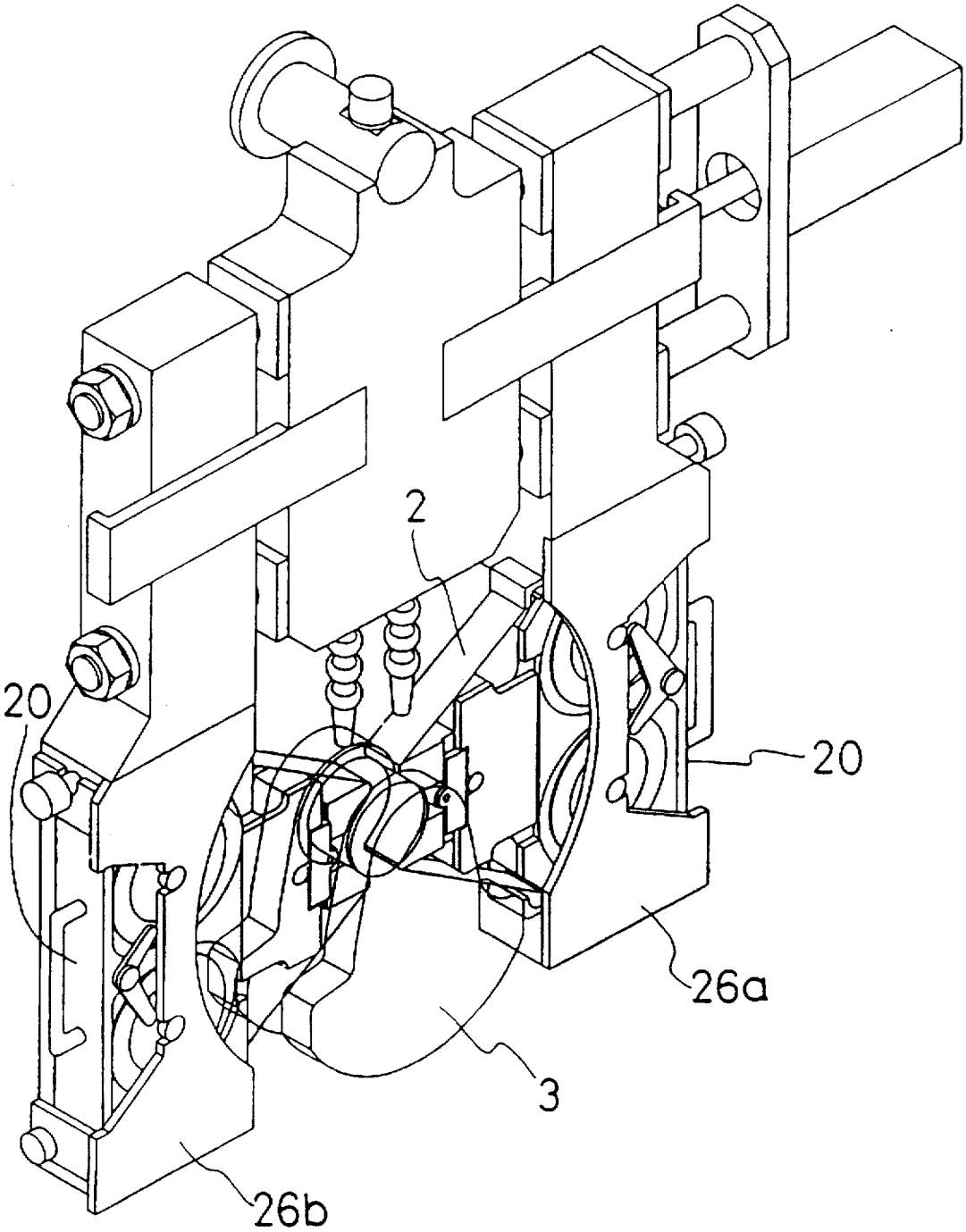
FIG. 3 is a perspective view showing peripheral portions of the clamp arm of the lapping apparatus according to a second embodiment of the present invention.

As shown in FIG. 3, the cassette type casings for storing the lap film 20 therein as described above are mounted from outside to the clamp arms **26*a*, 26*b* respectively such that the casings are opposed to each other. Then, the workpiece 3 is clamped by the clamp arms 26*a*, 26*b* and the grinding operation is performed. After a single grinding operation has been completed, the lap film 2 is fed. The procedure for feeding the lap film 2** will be described below.

First, the clamp arms **26*a*, 26*b* are opened and then the workpiece 3 is shifted upward. As shown in FIG. 4, a film winding apparatus 27 is provided at the upper shift position. Although only a single film winding apparatus 27 is shown in the figure, in reality, a pair thereof are disposed on the right and left sides. The film winding apparatus 27 has a reel shaft 28 for driving the winding reel 23 and a releasing member 29 for releasing the stopper 25. As a drive means for the reel shaft 28, a motor 30 or the like is used. A spline 281 is formed along the circumference of the reel shaft 28. Furthermore, in the center of the winding reel 23 provided is a reel hole 232 which is designed to engage the spline 281 of the reel shaft 28. The rotation shaft 253 of the stopper 25 can be pressed directly by the releasing member 29**.

By bringing the film winding apparatus 27 close to the casing 21, the reel shaft 28 engages the reel hole 232. The releasing member 29 presses the stopper 25 to remove it from the side faces of the winding reel 23 and the supply reel 24, thereby to release the restriction of the rotational movement of the winding reel 23 and the supply reel 24. In this state, by driving the reel shaft 28, the winding reel 23 is rotated by a predetermined angle to wind used film off the front side of the shoe 22 and at the same time, unused film is drawn out from the supply reel 24. After that, by removing the film winding apparatus 27 from the casing 21, the stopper 25 is fitted to the side faces of the winding reel 23 and the supply reel 24 so as to restrict the rotational movement of the winding reel 23 and the supply reel 24. Then, the clamp arms **26*a*, 26*b* (see FIG. 3) are shifted downward to clamp the workpiece 3**.

According to the second embodiment of the present invention having the aforementioned construction, the guiding means for the lap film 2 formed in the shoe 22 (with the same construction as in the first embodiment) also contributes to the elimination of the wasteful high pressure clamping operation. Thus, the clamp arms **26*a*, 26*b*, the casing 21, the shoe 22 and the like are released from a possibility of being subjected to a strong stress thereby improving the durability of the apparatus. Additionally, a process in which an unreasonable stress is applied to the lap film 2 is eliminated thereby preventing the lap film 2 from being cut. Further, as in the first embodiment, it is possible to prevent the lap film 2 from being slipped off the shoes 22 and further improve ease of handling of the lap film which is an advantage of use of the cassette storage type lap film 20** in the lapping apparatus.

Next, the third embodiment of the present invention will be described with reference to FIGS. 5–9. In this embodiment, a detailed description of the same part as and equivalent part to the first and second embodiments is omitted. The third embodiment will be also explained with a type in which the cassette storage type lap film 20 is loaded on the clamp arms 26*a*, 26*b* (see FIG. 3) as in the second embodiment.

Figure 5:
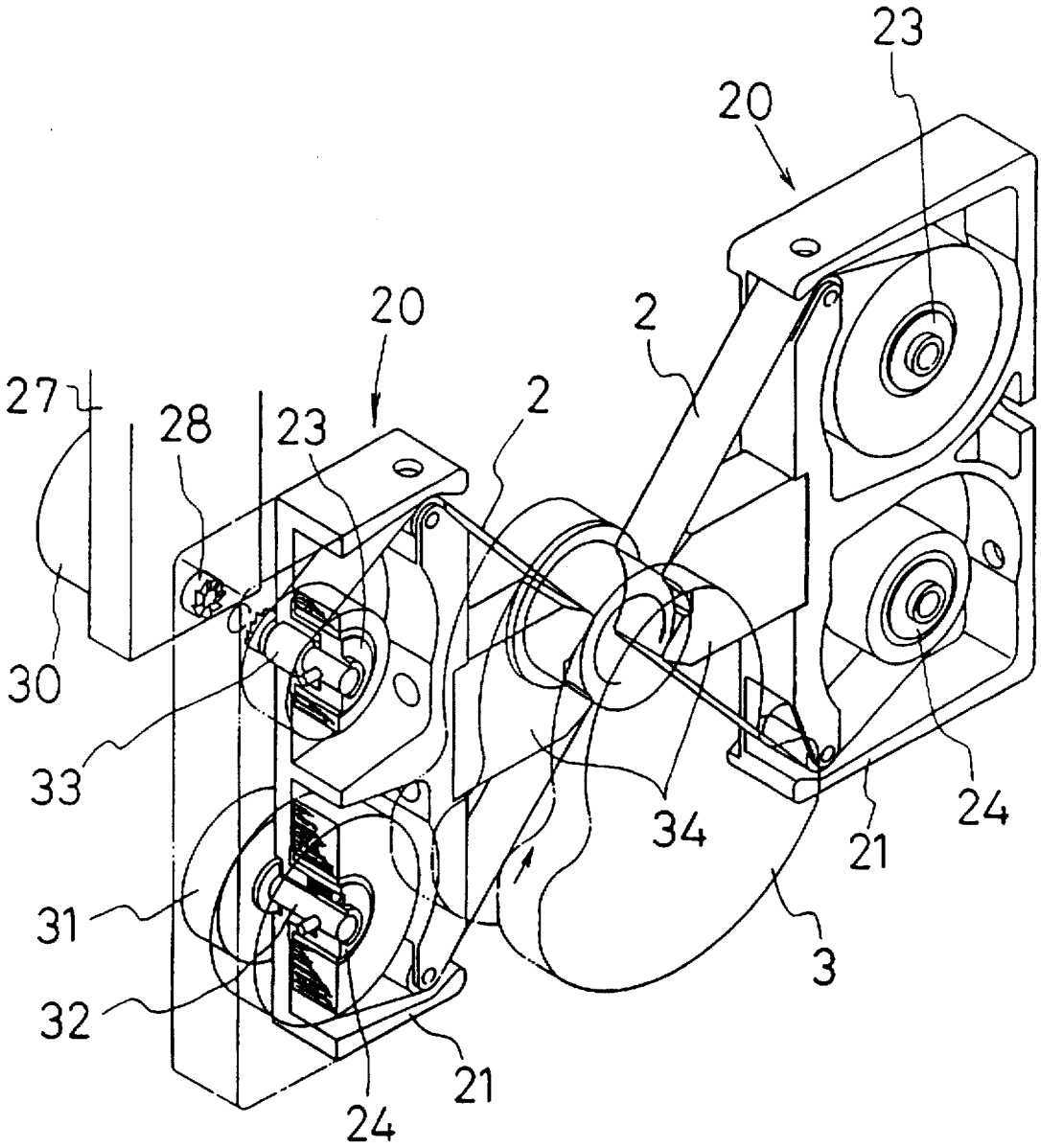
FIG. 5 is a perspective view showing the internal construction of the lapping apparatus according to a third embodiment of the present invention.
Figure 12:
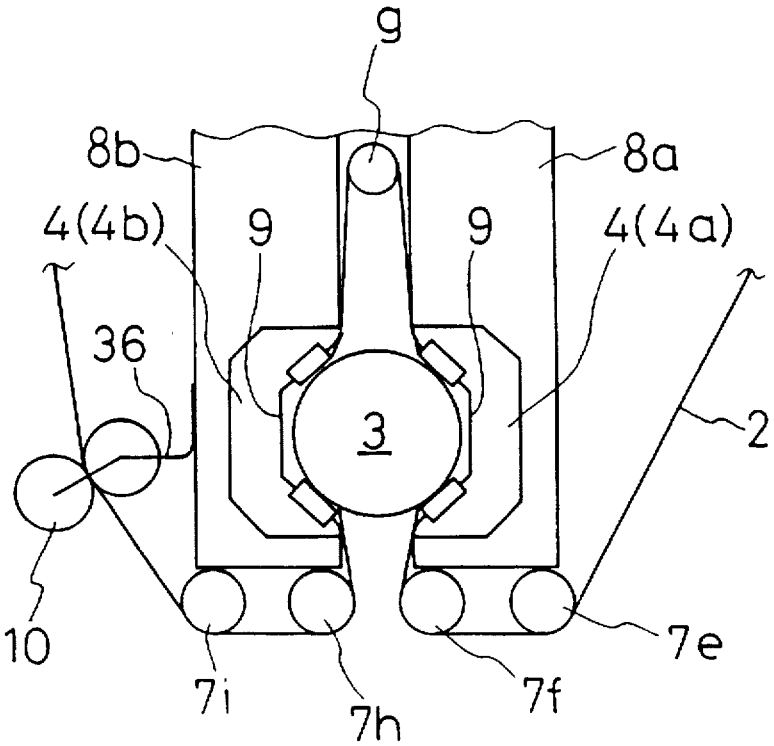
FIG.12 PRIOR ART
FIG. 12 is a schematic diagram showing a grinding operation by means of the lapping apparatus as shown in FIG. 10.
Figure 13:
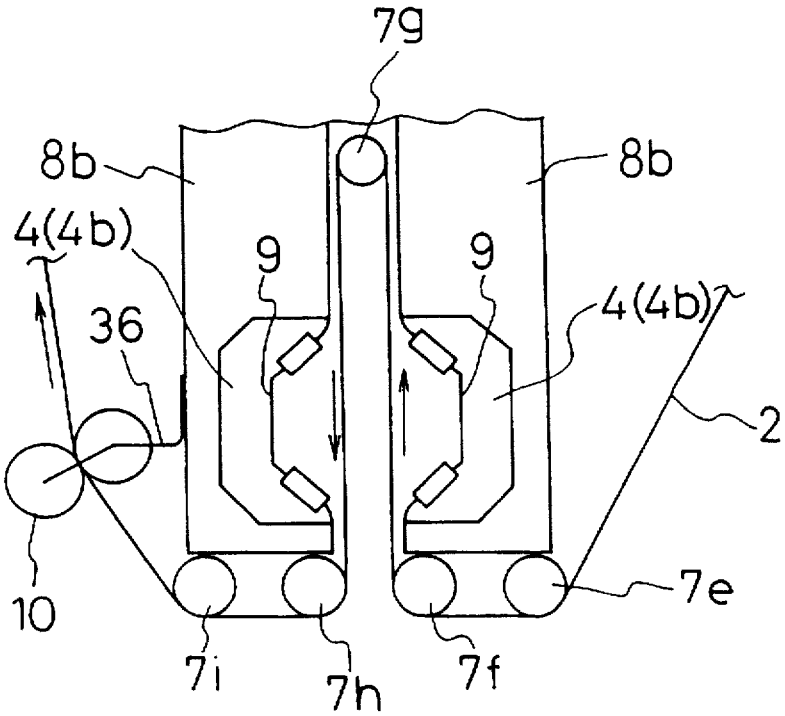
FIG.13 PRIOR ART
FIG. 13 is a schematic diagram showing a first step of the lap film feeding operation by means of the lapping apparatus as shown in FIG. 10.

FIG. 5 shows the third embodiment of the present invention. Although only a single film winding apparatus is shown in the figure, in reality, a pair thereof are provided on the right and left sides. Meanwhile, the third embodiment is different from the first and second embodiments in the following respects. First, a motor 31 serving as a drive means for the supply reel 24 is disposed in the clamp arms 26*a*,26*b* (see FIG. 3), and the supply reel is permanently connected to the drive shaft 32 of the motor 31. The winding reel 23 is supported on a winding shaft 33 which incorporates a one-way clutch disposed in the casing 21 so as to prevent the lap film 2 from proceeding in the opposite direction. The coupling faces of the winding shaft 33 and the reel shaft 28 have a shape of mating clutch. The construction using the stopper 25 as described in the second embodiment for restricting the rotational movement of the winding reel 23 and the supply reel 24 is eliminated in this embodiment. The shoes 34 supported by the casings 21 are not provided with any guiding means for the lap film 2 unlike the shoes 14, 22 in the first and second embodiments. That is, the shoe 34 is constructed in the same way as the conventional shoe 4 (see FIGS. 12 through 14).

Figure 6:
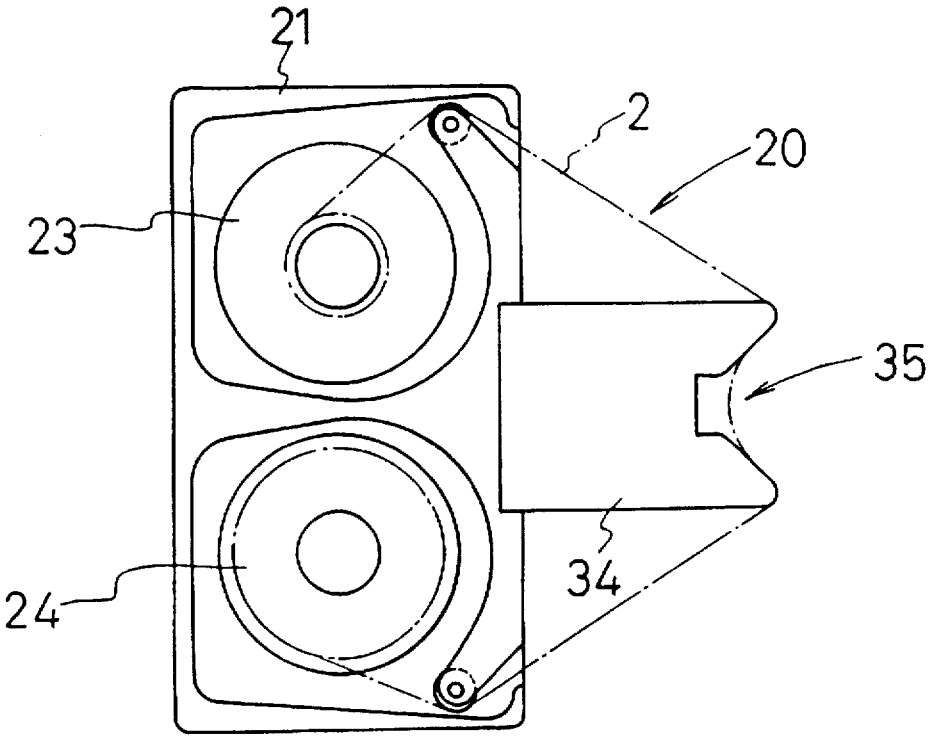
FIG. 6 is a diagram schematically showing one of the opposed cassette type casings for storing the lap film of the lapping apparatus as shown in FIG. 5, showing a first step of the lap film feeding operation.

The steps for feeding the lap film 2 in the third embodiment will be described with reference to FIGS. 6 through 9. Although FIGS. 6 through 9 show only one of the cassette type casings for storing the lap film 20, in reality, two of them are disposed on the right and left sides with respect to the workpiece respectively, and they operate similarly. After a single grinding operation has been completed, the clamp arms 26*a*, 26*b* (see FIG. 3) are opened and the workpiece is shifted upward. As shown in FIG. 5, by bringing the film winding apparatus 27 prepared at the shift position close to the casing 21, the reel shaft 28 is directly coupled with the winding shaft 33. FIG. 6 shows the cassette type casing for storing the lap film 20 in this state. The lap film 2 is in close contact with the workpiece retaining section 35 of the shoe 34 such that the film 2 is fitted to the face of the workpiece to be processed during the grinding operation.

Figure 7:
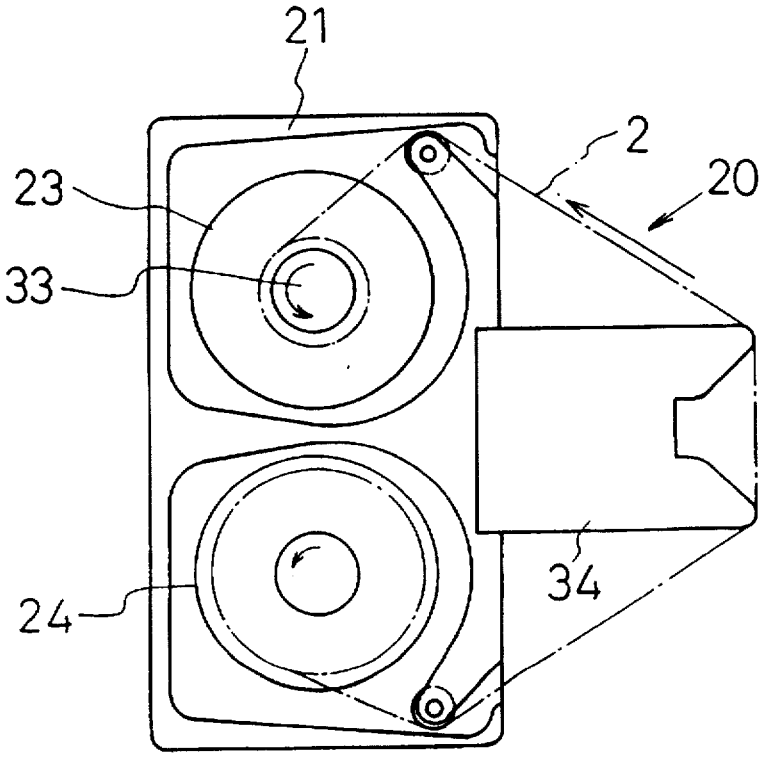
FIG. 7 is a schematic diagram showing a second step of the lap film feeding operation by means of the lapping apparatus as shown in FIG. 5.

Next, as shown in FIG. 7, by driving the winding shaft 33 by means of the motor 30 (see FIG. 5), the winding reel 23 is rotated by a predetermined angle to wind used film from the workpiece retaining section 35 of the shoe 34. At this time, the motor 31 is allowed to rotate freely such that the lap film 2 can be drawn out of the supply reel 24. Then, the portion of the lap film 2 which faces the shoe 34 leaves the workpiece retaining section 35. As a result, the portion extends to form a straight line. In this state, the film winding apparatus 27 is removed from the casing 21 to release coupling between the reel shaft 28 and the winding shaft 33, and then the clamp arms 26*a*, 26*b* are shifted downward.

Figure 8:
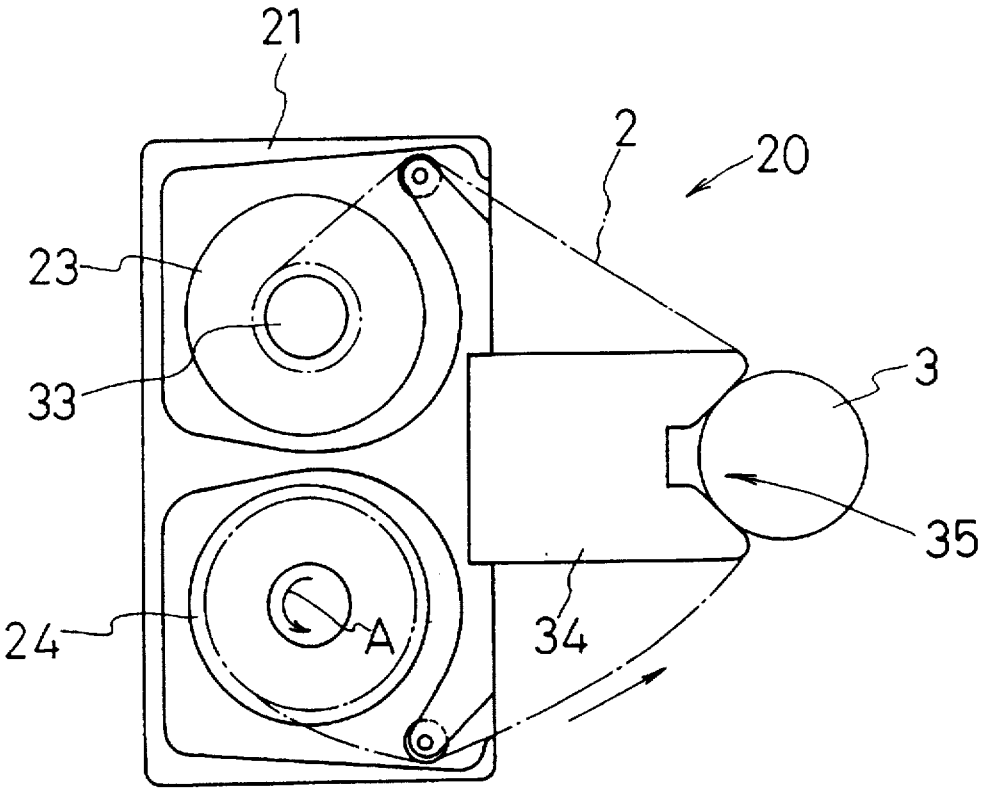
FIG. 8 is a schematic diagram showing a third step of the lap film feeding operation by means of the lapping apparatus as shown in FIG. 5.

Then, as shown in FIG. 8, the workpiece 3 is clamped again. At this time also, the motor 31 is allowed to rotate freely. Depending on a case, the lap film may be fed positively by rotating the supply reel 24 in the direction of arrow A by means of the motor 31. As described above, because the winding reel 23 is supported on the winding shaft 33 which incorporates the one-way clutch therein, the possibility of the lap film 2 proceeding in the opposite direction from the winding reel 23 is eliminated. Thus, when the workpiece 3 is clamped by the shoes 34, the lap film 2 can be drawn out of the supply reel 24 and brought into close contact with the face of the workpiece 3 to be processed. Moreover, there is no significant stress applied to the lap film 2, the winding reel 23, the supply reel 24 or the like.

Figure 9:
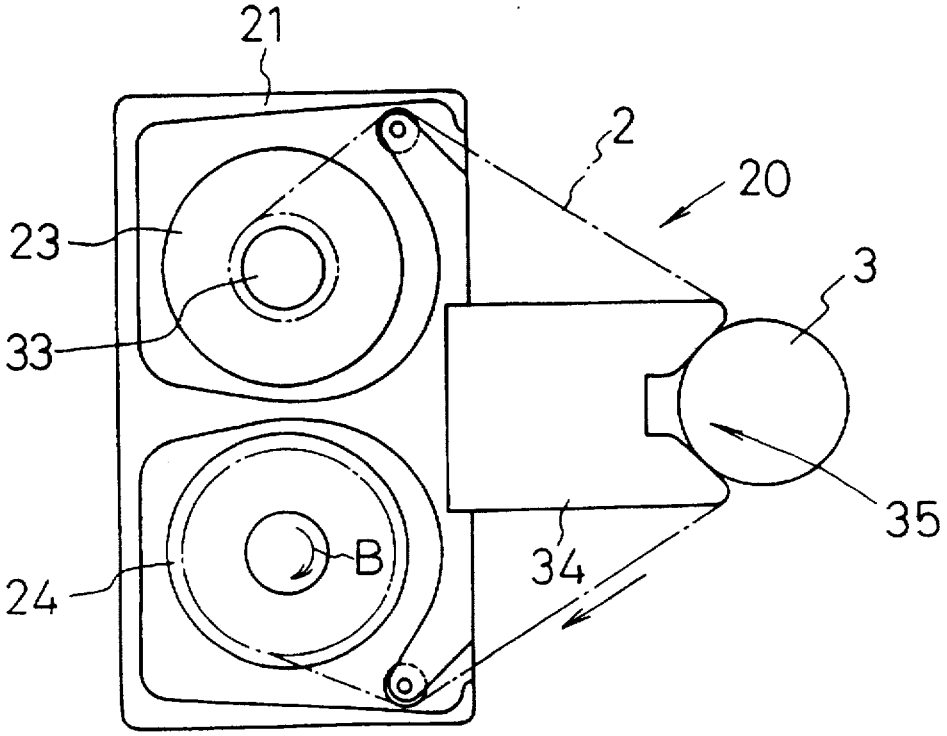
FIG. 9 is a schematic diagram showing a final step of the lap film feeding operation by means of the lapping apparatus as shown in FIG. 5.
Figure 10:
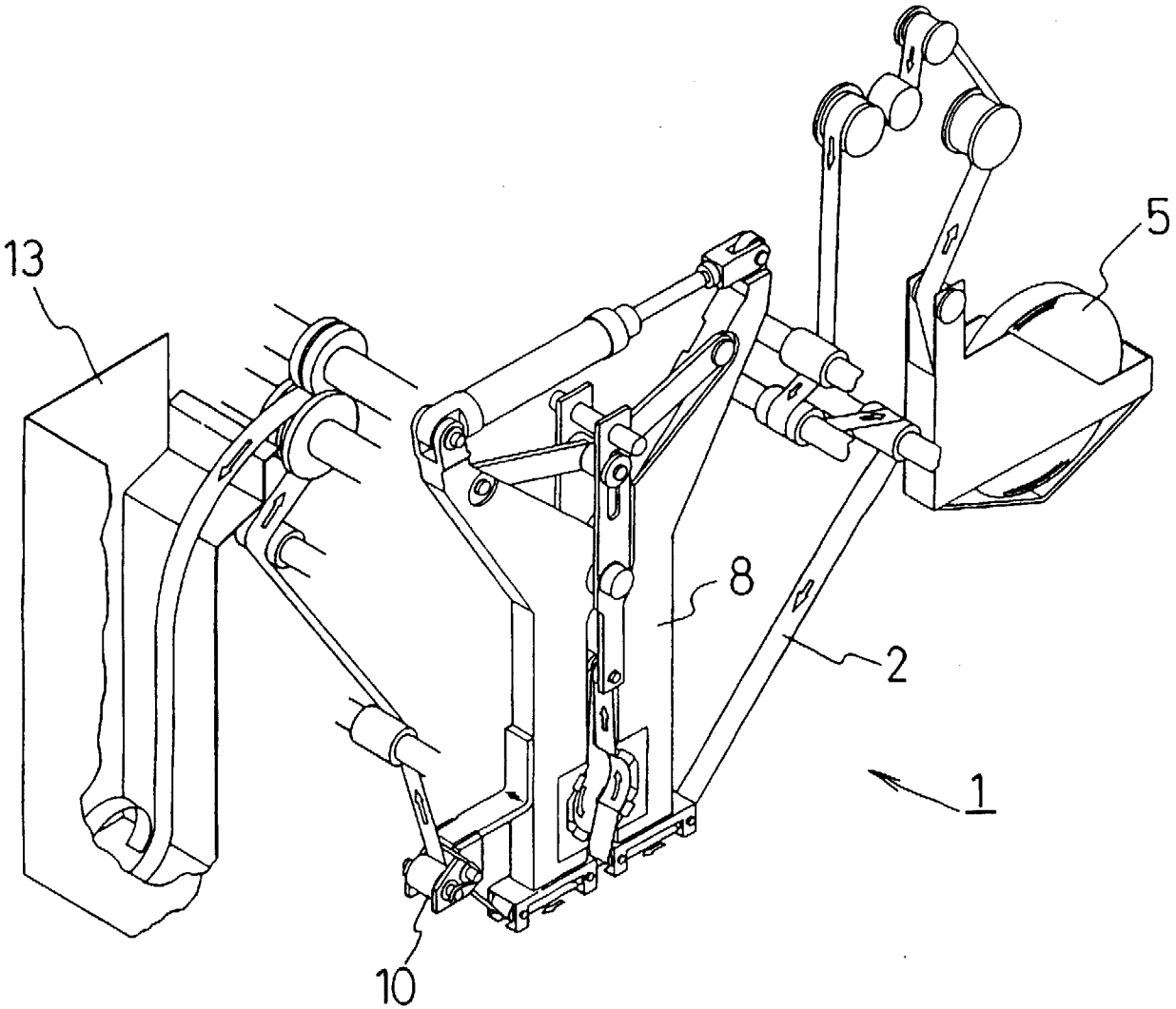
FIG.10 PRIOR ART
FIG. 10 is a perspective view showing a conventional lapping apparatus.
Figure 11:
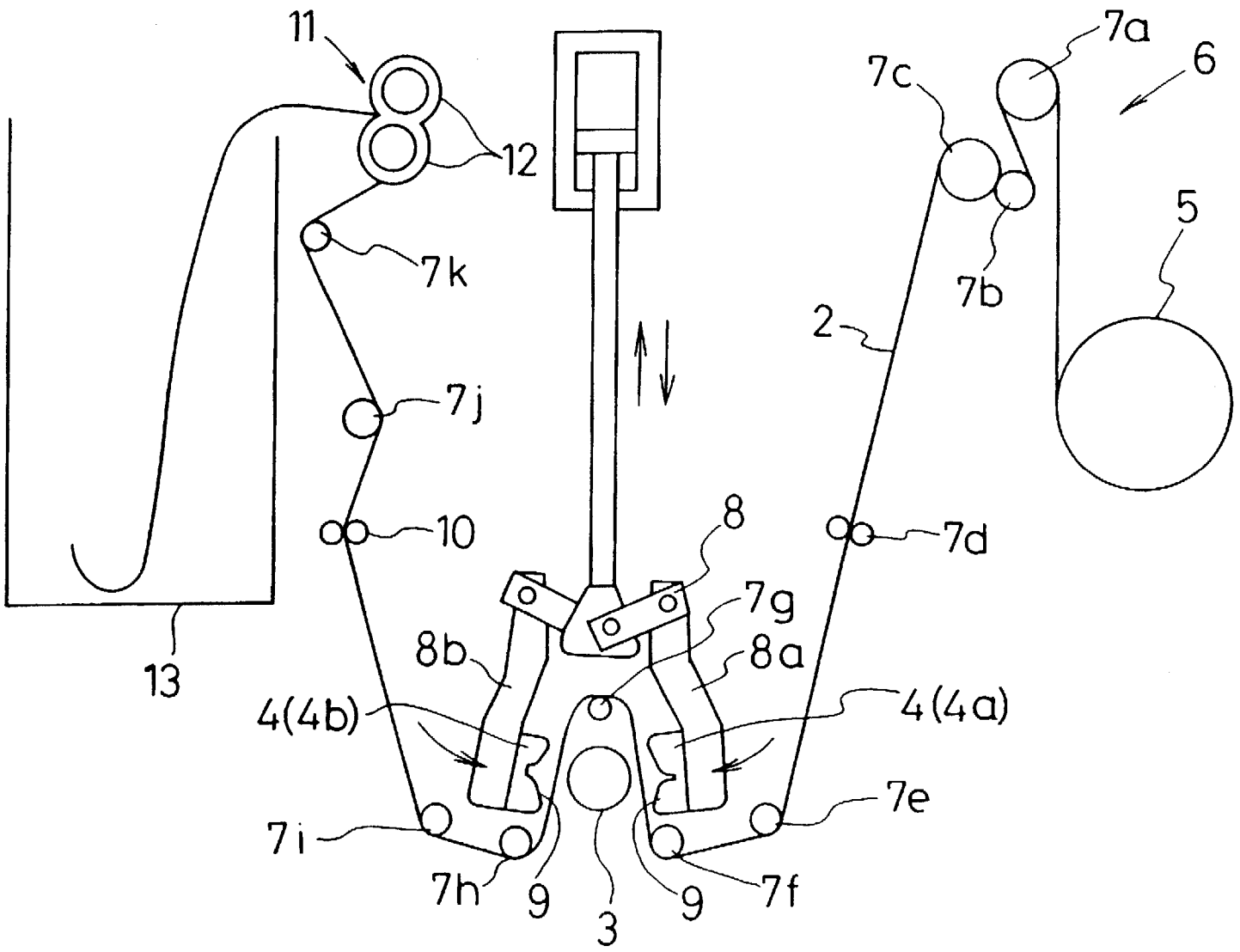
FIG. 11 PRIOR ART
FIG. 11 is a schematic diagram showing a construction of the lapping apparatus as shown in FIG. 10.

Although the lap film 2 may slack between the supply reel 24 and the shoe 34, as shown in FIG. 9, the supply reel 24 is rotated in the direction of arrow B by means of the motor 31 to eliminate such slack, thereby to apply an appropriate tension to the lap film 2. In the steps as described above, the operation for feeding the lap film 2 is terminated and the workpiece 3 is ready to be rotated and ground. In performing the grinding operation, the motor 31 restricts the rotational movement of the supply reel 24 to prevent the lap film 2 from being drawn out excessively. Needless to say, the construction in this embodiment may be employed in the lapping apparatus as of the prior art, which does not use the cassette type casings for storing the lap film 20.

Operation and effect of the third embodiment of the present invention will be described in the following. In winding used film on the winding reel 23 (see FIG. 7) and retaining the workpiece 3 by the workpiece retaining sections of the shoes 34 (see FIG. 8), the lap film 2 is allowed to be drawn out freely from the supply reel 24. Thus, any significant stress is prevented from being applied to the lap film 2, the winding reel 23, the supply reel 24 or the like. If the lap film which has been drawn out excessively from the supply reel 24 slacks, it is possible to remove the slack by rotating the supply reel 24 by means of the motor 31 which is a drive means for applying an appropriate tension to the lap film 2 (see FIG. 9). That is, the lap film is wound by driving the winding reel 23 by the motor 30, and the tension applied to the lap film 2 is adjusted by driving the supply reel 24 by the motor 31. Thus, the grinding operation may be performed without causing any problem. Because no significant stress is applied to the lap film 2 or the like as described above, it is possible to prevent the lap film 2 from being cut and the casing 21 and other components of the apparatus from being damaged. Additionally, the high pressure clamping operation is not required as in the conventional apparatus, it is possible to prevent the shoes 34 from being damaged.

In the first to third embodiments as described hitherto, methods for rotating the workpiece clamped by the shoes relative to the lap film have been shown. However, the present invention is not limited to these embodiments and a case in which the shoes are rotated relative to the workpiece is also included.

The present invention, which is constructed as described above, presents the following effects. Because the guiding path of the lap film remains unchanged by providing the guiding means for fitting the lap film to the recessed wall surfaces formed in the shoes of the workpiece retaining section, the high pressure clamping operation for fitting the lap film to the face of the workpiece to be processed is unnecessary. Thus, there is no operation in which a significant stress is applied to the lap film, the shoes or the like, which prevents the lap film from being cut and improves the durability and the reliability of the lapping apparatus. Although conventionally the pressure reducing operation was required before the grinding operation to supplement the deterioration in operation accuracy caused by the high pressure clamping operation, such wasteful pressure reducing operation is eliminated in the present invention. Thus, operation control is simplified.

The feeding mechanism for the lap film comprises the winding section and the supply section for the lap film. If drive means are provided on the winding section and the supply section respectively, the lap film can be drawn out freely from the supply section. In this case, no significant stress is applied to the lap film when the workpiece is clamped. Furthermore, even if the lap film slacks, the slack may be removed by driving the supply section and thereby applying an appropriate tension to the lap film. Therefore, the conventional high pressure clamping operation is not required, and it is possible to prevent the lap film from being cut off. Thus, the durability and the reliability of the lapping apparatus is remarkably enhanced.

What is claimed is:

1. A lapping apparatus comprising:

a lap film;

a pair of feeding mechanisms;

a pair of clamp arms having opposed faces and recessed wall surfaces on the opposed faces, on which workpiece rataining sections are provided, between which and a workpiece the lap film runs for lapping the workpiece; and lap film guide means provided in the recessed wall surfaces for constantly fitting the film along the surface of the workpiece retaining sections, wherein said guide means is formed as a deep groove provided in a central portion of each of the recess wall surfaces and comprises a film roller disposed in the groove.

2. A lapping apparatus comprising:

a lap film;

a lap film feeding mechanism comprising a winding section and a supplying section for guiding said lap film provided on a pair of shoes, and means for driving the winding section and the supplying section respectively;

a pair of clamp arms having opposed faces and recessed wall surfaces on the opposed faces, on which workpiece retaining sections are provided, between which and a workpiece the lap film runs for lapping the workpiece;

lap film guide means provided in the recessed wall surfaces for constantly fitting the film along the surface of the workpiece retaining sections, wherein said guide means is formed as a deep groove provided in a central portion of each of the recess wall surfaces and comprises a film roller disposed in the groove; and workpiece rotating means for rotating the workpiece relatively with the lapping direction.

* * * * *